US005095883A

United States Patent [19]

Kurtz

[11] Patent Number: 5,095,883

[45] Date of Patent: Mar. 17, 1992

[54] CROSSBOW BOLT ANCHORING SYSTEM

[76] Inventor: Eugene D. Kurtz, 816 Sagebrush Trail SE., Albuquerque, N. Mex. 87123

[21] Appl. No.: 592,641

[22] Filed: Oct. 3, 1990

[51] Int. Cl.[5] ..... F41B 5/00

[52] U.S. Cl. ..... 124/25; 124/44.5

[58] Field of Search ..... 124/25, 44.5, 41.1, 124/24.1, 26, 86, 88; 273/421, 420, 419, 416

[56] References Cited

U.S. PATENT DOCUMENTS

| | | | |
|---|---|---|---|
| 3,224,427 | 12/1965 | Ronan | 124/25 |
| 3,244,161 | 4/1966 | Jenson | 124/44.5 X |
| 3,515,113 | 6/1970 | Lawrence | 124/25 X |
| 4,206,740 | 6/1980 | Lydon | 124/25 |
| 4,722,318 | 2/1988 | Yankey | 124/25 |
| 4,860,719 | 8/1989 | Scheiterlein | 124/25 |
| 4,926,834 | 5/1990 | Chauvin | 124/25 |

*Primary Examiner*—Peter M. Cuomo

[57] ABSTRACT

In a hunting crossbow of the type which employs a bolt raised above the crossbow stock and supported at only two points along its length, a bolt anchoring system is provided which cooperates with these supporting points, i.e., the bolt rest and string latch mechanism, to releaseably retain a broadhead-tipped bolt in ready-firing position through a greater range of movement by a hunter than would be possible without employing the system. The primary system component is a rubber arm-like device which, is mounted to the underside of the forward end of the crossbow stock, a position from which it can be readily employed by being swing upward and connected to a hunting broadhead and to which it will instantly return once the bolt has been released avoiding contact with bolt and fletching and allowing the bolt to continue on to its mark without interference.

7 Claims, 4 Drawing Sheets

CROSSBOW BOLT ANCHORING SYSTEM

BACKGROUND AND FIELD OF THE INVENTION

A modern hunting crossbow of the type shown in U.S. Pat. No. 4,206,740 utilizes a bolt raised above the upper surface of its stock supported by a latch mechanism at the rear end of the stock and a simple gravity rest at the forward end of the stock to keep the bolt in ready-firing position prior to firing (release). Once the weapon is cocked (string pulled back and latched in said mechanism) the bolt is knocked to the string and thereby firmly secured at its trailing end. At its leading end, however, the bolt lays nestled in a shallowly notched rest, also shown in U.S. Pat. No. 4,206,740, held tenuously in place by gravity, until firing. Under controlled conditions such as when the hunter is sighting in his weapon, this arrangement is sufficient. Under normal hunting conditions, when a hunter is maneuvering for a shot from either a ground or tree stand, this arrangement is woefully inadequate and potentially unsafe because of the bolt's tendency to fall noisily off its rest with the slightest movement. Should this occur at the moment of firing, game may be frightened away and/or the bolt may consequently be released in an undesirable direction.

Efforts to develop means to releaseably retain a bolt on its rest in ready-firing position until release from a crossbow of this type are evidenced in U.S. Pat. Nos. 4,722,318 and 4,860,719.

In U.S. Pat. No. 4,722,318 a spring-tensioned resilient tang is lowered into position atop the leading end of the bolt, just behind the bolt's tip, sandwiching the bolt between it and the bolt rest beneath to hold the bolt in place on its rest.

In U.S. Pat. No. 4,860,719 a magnet is cradled at the forward end of a crossbow stock beneath the metal tip of the bolt, a position from which it exerts force on the metallic bolt tip, pulling it downward to hold the bolt in place on its rest.

These patents and other activity in this area evidence the importance to a crossbow hunter of keeping the bolt quietly in place on its rest with the crossbow in a cocked configuration ready for firing through a wide range of movement normally encountered by the hunter short of jarring the crossbow.

SUMMARY OF THE INVENTION

In accordance with the present invention, a bolt anchoring device is provided for application as a means to hold a crossbow bolt in place on its rest ready for firing, and without interfering with the flight of the bolt upon firing, through a greater range of movement by a bowhunter than would be possible without use of this system.

The bolt anchoring device of the present invention is intended for use with a hunting crossbow of the type which employs a bolt which is raised above the crossbow stock and supported at only two points along its length; at the front by means of a simple gravity rest mounted adjacent the forward end of the crossbow stock, and at the rear by means of "knocking" the bolt in the horizontally-postured bow string which is locked in position by means of a latch mechanism housed atop the rear end of the crossbow stock. In a preferred embodiment of the invention, the bolt anchoring device is attached to the underside of the forward end of the crossbow stock and is bent upward to engage the tip of a broadhead blade, the blade being an integral part of a hunting broadhead which is mounted adjacent the leading end of a bolt, and gently hold the bolt in place. Working in conjunction with the bolt rest, the bolt anchoring device keeps the bolt from moving left, right, up, or down. And, once knocked (fitted to the bow string), the bolt cannot slide forward or back. In effect, the bolt anchoring device gently "anchors" the bolt to its rest. As the bolt starts forward upon release, the broadhead flies cleanly away from the device which then instantly springs down to its original mounting position, out of the way of bolt shaft and fletching, avoiding contact with the bolt and allowing it to continue on to its mark without interference.

These and other features and advantages of the invention will become apparent from the following description.

DESCRIPTION OF THE PREFERRED EMBODIMENTS

Figure 1:
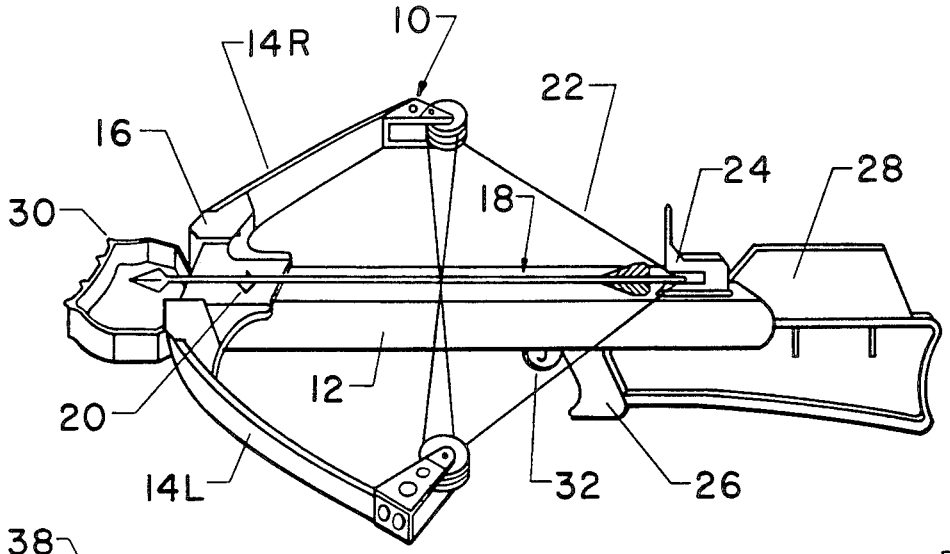
FIG. 1 PRIOR ART
FIG. 1 is a perspective view of a crossbow of the type used with the invention.

As depicted in FIG. 1 of the drawings, a crossbow 10, includes a stock 12 and bow limbs 14R and 14L joined by a holder 16 at the forward end of the stock 12. This more or less conventional crossbow employs a bolt 18 which is raised above the stock and supported at only two points along its length; at the front by being seated in a simple gravity rest 20, and at the rear by means of being "knocked" in the horizontally-postured bow string 22 which is locked in position by means of a latch mechanism 24 housed atop the rear end of the crossbow stock 12. Additional features of this type crossbow include a pistol grip handle 26 and cheekpiece 28 for holding and shouldering the weapon, a stirrup 30 to facilitate cocking the weapon, and a trigger mechanism 32 for releasing the latch mechanism 24 and firing (launching) the bolt 18.

Figure 2:
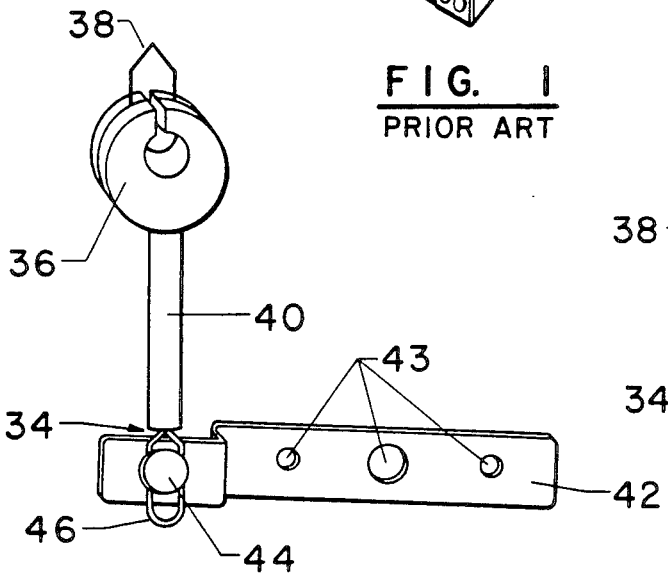
FIG. 2 PRIOR ART
FIG. 2 is a perspective view of a conventional arrow holder designed for use with conventional bow.

FIG. 2 depicts a commercially available conventional arrow holder 34 of the type shown in U.S. Pat. No.

3,244,161 designed for use with conventional (upright) bows. The forward and rear portions of the arrow holder are obliquely angled in this drawing to illustrate its adjustment capabilities. The forward portion of the arrow holder 34 consists of a Gripper Claw 36 and Pincers 38 assembly which is attached by means of a rubberized springtensioned arm 40 to a malleable metal base 42, comprising the rear portion of the arrow holder 34, by a knurled nut 44 threaded through the spring arm's slide rails 46 into a threaded hole in the malleable metal base 42. The metal base 42 normally has pre-drilled holes 43 for mounting purposes.

Figure 3:
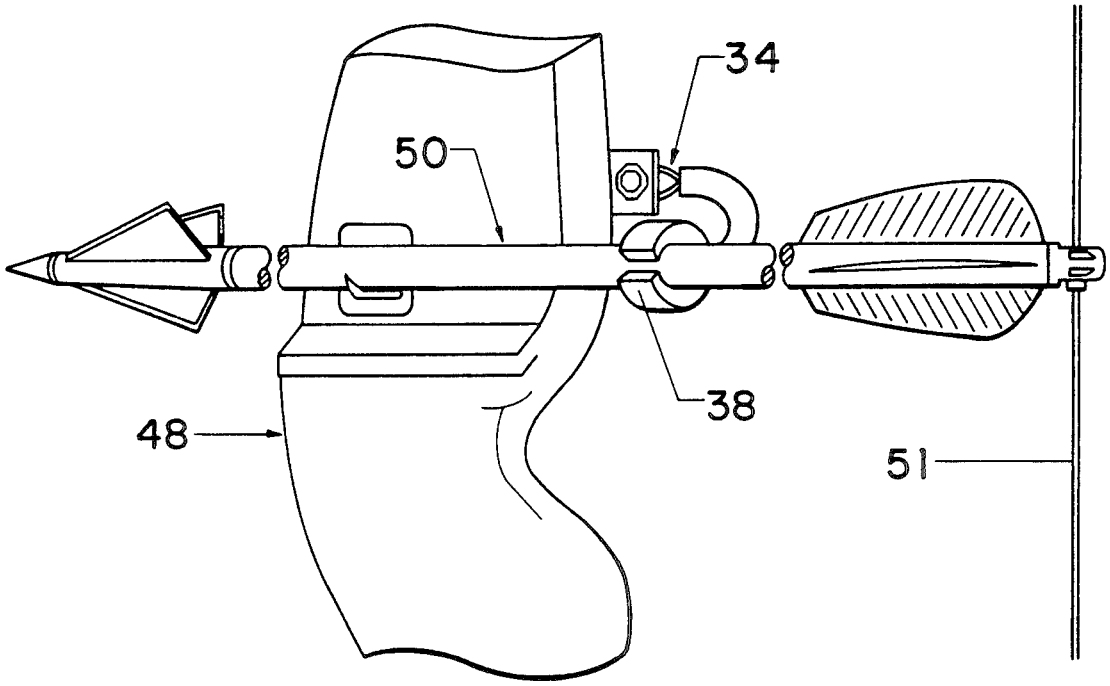
FIG. 3 PRIOR ART
FIG. 3 is a sectional view of the conventional arrow holder employed with a conventional bow.

FIG. 3 shows the conventional arrow holder 34 employed as designed, i.e., attached to an undrawn conventional (upright) bow 48 with its Pincers 38 enveloping (grabbing) the shaft of an arrow 50 which has been knocked in the bow 48, thereby holding the arrow 50 in place on the undrawn bow 48 until the bowstring 51 is drawn back, at which time the arrow holder 34 pulls free of the arrow shaft and springs back to its original mounting position out of the way of the arrow 50 prior to its release.

Figure 4:
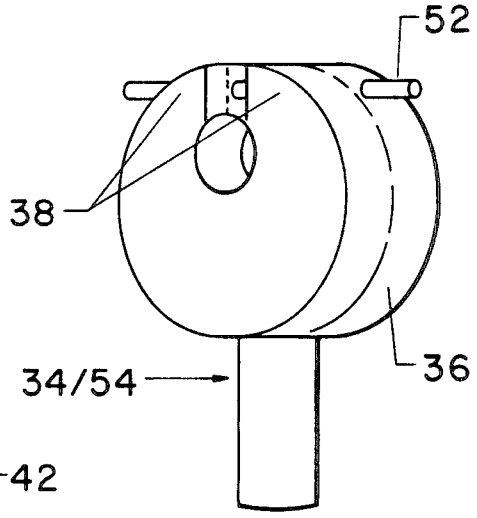
FIG. 4 is a close-up view of the bolt anchoring device of the present invention.
Figure 7:
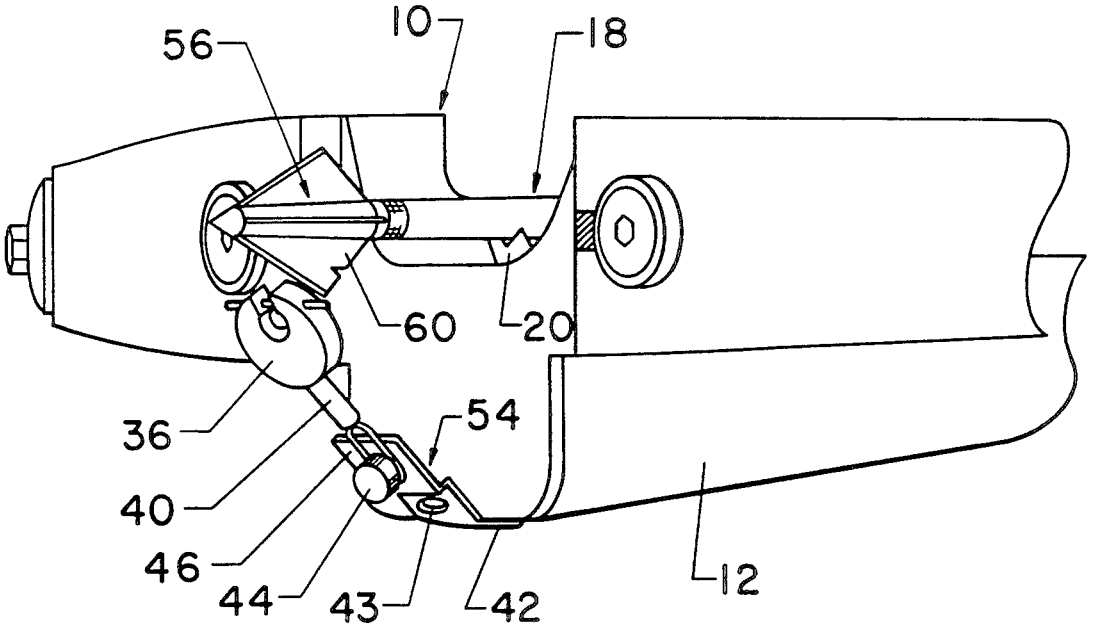
FIG. 7 is a perspective view of the forward end of a crossbow showing the bolt anchoring device mounted to the lower surface of the forward end of the stock relative to the bolt.
Figure 9:
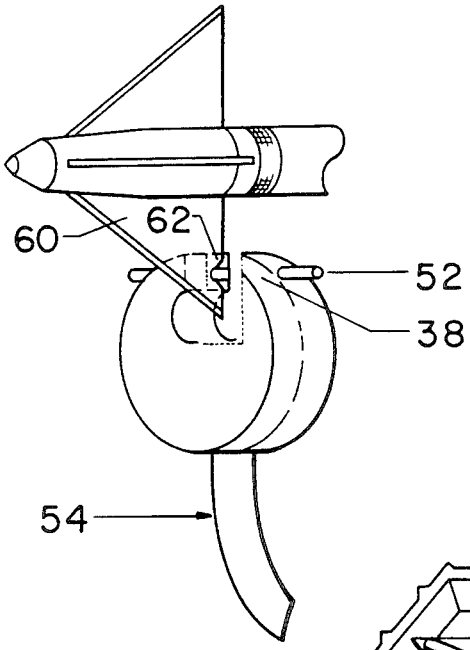
FIG. 9 is a close-up phantom view of the bolt anchoring device showing the relationship of the pin to the notched blade.

FIG. 4 shows a bolt anchoring device 54 including a holder 36 having a pair of jaws or leg portions 38. The holder 36 is mounted at a forward end portion of a spring-biased arm 40 (FIG. 7). A pin 52 is provided through the leg portions 38 of the holder 36. The pin 52 is inserted through the center of an outer surface of each of the leg portions 38 to allow a trailing edge of the broadhead blade 60 (shown in FIG. 5) to be received into a slot formed by a pair of inner surfaces of the leg portions 38 thereby imparting more lateral stability to the bolt 18 (as illustrated in FIG. 9). After the pin 52 has been inserted through the leg portions 38, the leg portions 38 are spread apart slight distance to accommodate the thickness of the broadhead blade used in the application. The leg portions 38 must not "grab" the broadhead blade 60 (shown in FIG. 5) just provide close support.

Figure 5:
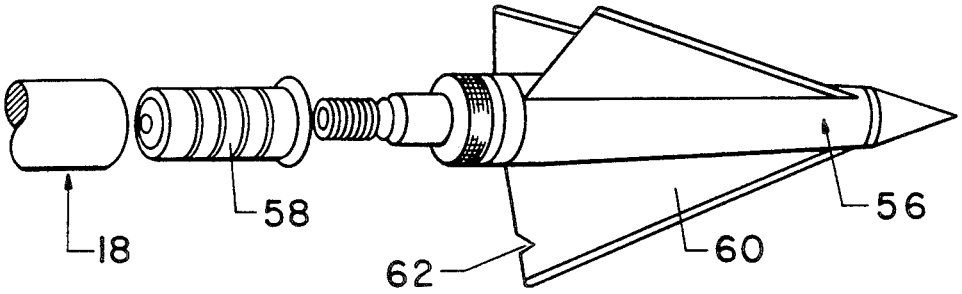
FIG. 5 is an exploded perspective view of a hunting broadhead incorporating a notched blade which is used with the bolt anchoring device of the present invention.

FIG. 5 shows an exploded perspective view which depicts a hunting broadhead 56 mounted adjacent the leading end of crossbow bolt 18 by means of screwing into a threaded bolt insert 58 which is glued into the hollow leading end of bolt 18. The hunting broadhead can have any number of removable or nonremovable blades one of which 60 has had a notch 62 filed into its trailing edge. The notch 62 has a V-shaped configuration and need only be deep enough, approximately one sixteenth inch, to engage and hold the pin 52 (shown in FIG. 4) seated in the device 54 (shown in FIG. 4). The lower edge of the notch 62 must angle down slightly to allow the pin 52 (shown in FIG. 4) to cleanly clear the notch 62 upon firing.

Figure 6:
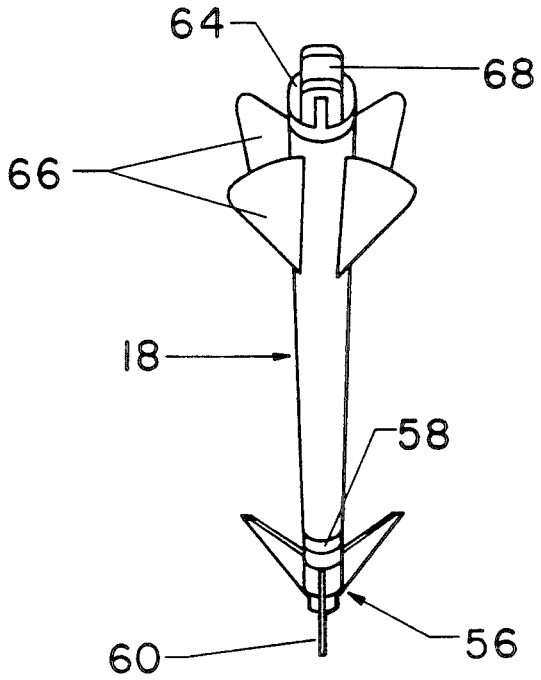
FIG. 6 is a depressed-angle rear view of a crossbow bolt as it would sit loaded in a cocked crossbow.

FIG. 6 is a depressed-angle view looking up at a crossbow bolt 18 as it would rest loaded in a cocked crossbow (shown in FIG. 1) and shows the proper alignment of the modified hunting broadhead 56 with the bolt knock 64 and fletching 66. The hunting broadhead 56 must be mounted to the leading end of the bolt 18 in a position whereby its notched blade 60 projects vertically downward perpendicular to the horizontal plane of the crossbow and the string gap 68 in the bolt knock 64. This is achieved by first mounting the hunting broadhead 56 to the leading end of the bolt 18 by screwing it into the broadhead insert 58 then heating the glue which holds the broadhead insert 58 and rotating the hunting broadhead/insert unit 56/58 to proper alignment. This vertical alignment of the notched broadhead blade 60 relative to the string gap 68 in bolt knock 64 constitutes the modification of the crossbow bolt 18.

With particular reference to FIG. 7, a metal base 42 is secured to a rear end portion of the spring-biased arm 40 and the anchoring device 54 is mounted on the lower surface of the forward end of, and in line with, the crossbow stock 12. The metal base 42 normally has pre-drilled holes 43 through one of which a screw may be threaded into an existing or tapped hole (not shown) in the lower surface of the forward end of the crossbow stock 12 to secure it to said stock 12. Exact positioning of the metal base 42 may differ with each type crossbow setup. Some setups may require an extension be fitted to the base 42 in order for it to reach the broadhead 56. Such an extension (not shown) may simply be compromised of the mating of two metal bases 42. Once secured to the stock 12, the malleable metal base 42 may be bent upward as needed, and the spring-biased arm 40 extended or retracted as necessary, by loosening knurled nut 44 and moving the slide rails 46 up or down accordingly, to position the holder 36 at an approximately 45 degree angle to the linear plane of the crossbow stock 12, just beneath the tip of the modified hunting broadhead 56 affixed to a bolt 18 that has been knocked to a cocked crossbow 10 with its leading end supported by the arrow rest 20. The holder 36 must be positioned low enough to clear the flight path of the bolt 18 and fletching 66 (not shown) after the bolt 18 is released upon firing.

Figure 8:
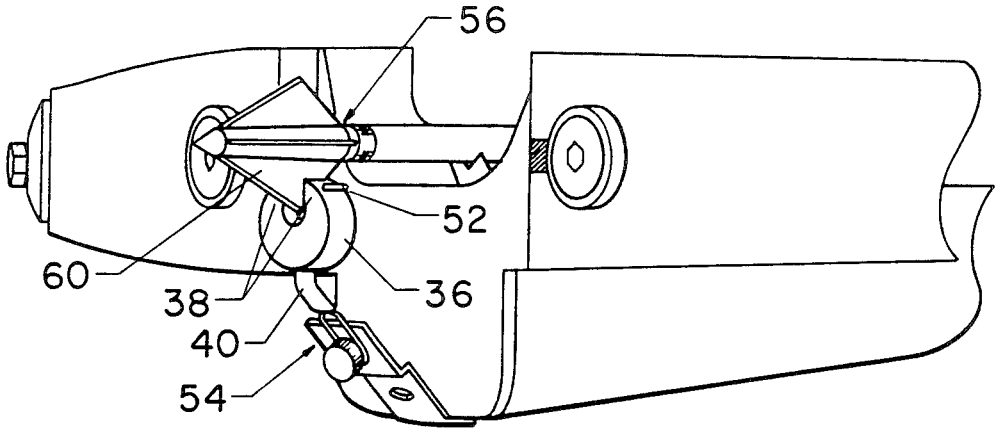
FIG. 8 is a perspective view of the forward end of a crossbow showing the bolt anchoring device engaged to the broadhead.

Once the holder 36 is positioned as depicted in FIG. 7, engagement of the device 54 to the hunting broadhead 56 is accomplished by bending the spring-arm 40 of the device 54 and bringing the holder 36 up behind the back of the notched broadhead blade 60 and fitting the leg portions 38 over the trailing edge of the notched blade 60 and laying the pin 52 into the notch 62 (shown in FIG. 5) as depicted in FIG. 8. This engagement of the device 54 to the notched broadhead blade 60 constitutes employment of the device 54.

FIG. 9 is a close-up phantom drawing of the device 54 engaged to the notched broadhead blade 60 showing the relationship of pin 52 and notch 62. Portions of one of the leg portions 38 has been cutaway in this drawing for clarity.

Figure 10:
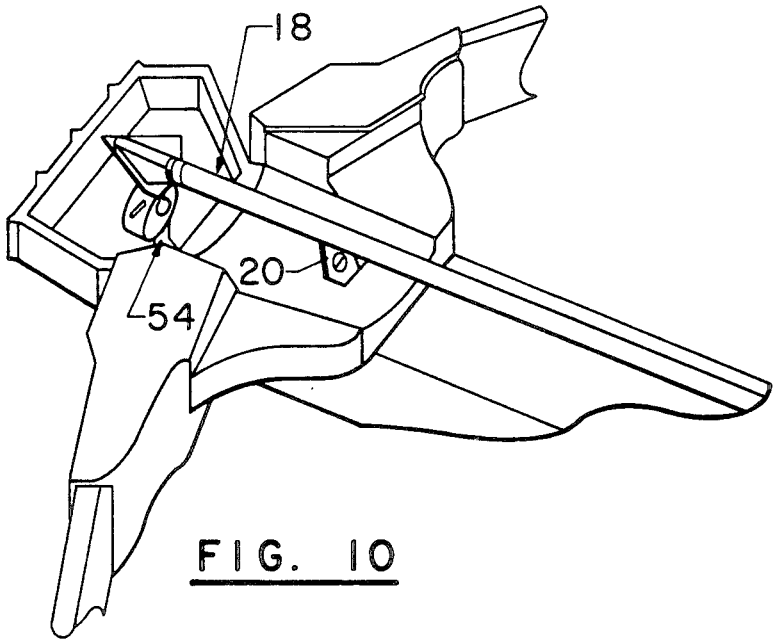
FIG. 10 is an oblique elevated-angle view of a crossbow with the bolt anchoring device employed holding a bolt in place on the rest.

When the now engaged device 54 is released from handling, the knocked bolt 18 should remain square on its rest 20 as shown in FIG. 10.

If the bolt does not remain square on its rest after the device is released from handling, the device must be adjusted by bending its base and/or extending or retracting its spring-arm as mentioned above. This adjustment may be accomplished while the device is engaged to the broadhead.

From the above description it will be seen that when properly employed and adjusted, the device gently holds the bolt on its rest by means of slight outward and downward force exerted by its spring-arm on the notched broadhead blade through the blade's contact with the device's pin. This force is extremely slight and affects the static but not dynamic interaction between the crossbow and bolt.

This gentle pressure keeps the bolt seated on its rest and prevents the bolt from moving left, right, up, or down. And, once knocked (fitted to the bowstring) the bolt cannot slide backwards or forwards. In effect, the bolt is gently "anchored" in place.

As the bolt starts forward as the trigger is pulled, the modified hunting broadhead cleanly flies away from the device which then instantly springs down to its original mounting position, out of the way of shaft and fletching, avoiding contact with the bolt and allowing said bolt to continue on to its mark without interference.

While the form of apparatus herein described constitutes a preferred embodiment of this invention, it is to be understood that the invention is not limited to this precise form of apparatus, and that changes may be made therein without departing from the scope of the invention which is defined in the appended claims.

I claim:

1. In a hunting crossbow having a frame, including a stock having an upper and lower surface and forward and rear end portions, flexible bow limbs joined by a limb holder mounted adjacent the forward end of said stock, a bowstring carried by said bow limbs, a bolt rest projecting upwardly above the upper surface of said stock adjacent the forward end thereof, a string latch mechanism mounted on the upper surface of said stock adjacent the rear end thereof, a broadhead-tipped bolt having leading and trailing ends, said bolt being supported at said leading end by said bolt rest and at said trailing end by said string latch mechanism with said bolt spaced from the upper surface of said stock, a trigger for releasing said latch mechanism, a bolt anchoring device comprising of a spring-biased arm having forward and rear end portions, a holder mounted to said forward end portion of said spring-biased arm, said holder being formed with a pair of leg portions having a slot therebetween, a pin extending through said leg portions of said holder and across said slot, said anchoring device being mounted adjacent to the lower surface of the forward end portion of said stock, said pin of said anchoring device engaging a notch provided in a downwardly projecting broadhead blade, said blade being integral to a hunting broadhead mounted adjacent the leading end of said bolt, said bolt being knocked in place on the crossbow, said crossbow being in a cocked configuration with said bowstring and said bolt knocked thereto and captured in said latch mechanism, said anchoring device and said notch of said broadhead blade being continuously engaged and holding said bolt on said rest until firing of said bolt from said crossbow, with said anchoring device disengaging from said notch of said broadhead blade when the bolt is fired and springing back instantly to an unengaged position thereby not interfering with the release of the bolt.

2. The assembly of claim 1 wherein said a notch having a "V" shaped configuration formed into the trailing edge of one of its broadhead blades, said notch being approximately one sixteenth inch deep and located approximately one third up the length of said trailing edge from the lowest tip of said broadhead blade, with lower edge of said notch angling slightly downward to facilitate clean release of said bolt.

3. The assembly of claim 1 wherein said bolt is rotated so that said hunting broadhead is mounted adjacent the leading end thereto to a position whereby said notched broadhead blade projects vertically downward perpendicular to the horizontal plane of said crossbow and a string gap in a bolt knock, said bolt knock being mounted adjacent the trailing end of said bolt.

4. The assembly of claim 1 wherein the rear end portion of said spring-biased arm of said bolt anchoring device is mounted to the lower surface of said stock by being mechanically screwed or otherwise affixed thereto.

5. The assembly of claim 1 wherein said bolt anchoring device is engaged to said notched broadhead blade by bending the forward end of said spring-biased arm of said device up behind the trailing edge of said broadhead blade and placing said pin in said notch formed in the trailing edge of said broadhead blade.

6. The assembly of claim 1 wherein said bolt anchoring device engaging said notch of said downwardly projecting broadhead blade exerts slight outward and downward force on said broadhead blade to releaseably retain said bolt lightly against said bolt rest in a ready-firing position on the rest prior to firing of said bolt to prevent inadvertent displacement of said bolt from ready-firing position through a greater range of movements by a hunter.

7. The assembly of claim 1 wherein said bolt anchoring device upon disengaging from said notch of said broadhead blade upon release returns instantly to its original mounting position below the flight path of said bolt thereby avoiding contact therewith and allowing said bolt to continue on to its mark without interference.

* * * * *